US006454205B2

(12) United States Patent
Niemeyer et al.

(10) Patent No.: US 6,454,205 B2
(45) Date of Patent: Sep. 24, 2002

(54) FIN-STABILIZED PROJECTILE

(75) Inventors: Torsten Niemeyer; Frank Guischard, both of Celle; Horst Fritsch, Hermannsburg, all of (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/820,892

(22) Filed: Mar. 30, 2001

(30) Foreign Application Priority Data

Mar. 30, 2000 (DE) ..... 100 15 514

(51) Int. Cl.[7] ..... F42B 10/14

(52) U.S. Cl. ..... 244/3.26; 244/3.24; 244/3.25; 244/3.27; 244/3.28; 244/3.29; 244/3.3

(58) Field of Search ..... 244/3.26, 3.27, 244/3.28, 3.29, 3.3, 3.1

(56) References Cited

U.S. PATENT DOCUMENTS

| | | | | | |
|---|---|---|---|---|---|
| 3,333,790 | A | * | 8/1967 | Durand, Jr. | 244/3.23 |
| 3,819,132 | A | | 6/1974 | Rusbach | |
| 4,296,895 | A | * | 10/1981 | Pazmany | 102/388 |
| 4,575,025 | A | * | 3/1986 | Sadvary et al. | 244/3.27 |
| 4,600,167 | A | * | 7/1986 | Kastenhuber et al. | 102/385 |
| 4,944,226 | A | * | 7/1990 | Wedertz et al. | 102/293 |
| H905 | H | * | 4/1991 | Rottenberg | 244/3.28 |
| 5,082,203 | A | | 1/1992 | Baubry | |
| 5,464,173 | A | * | 11/1995 | Sharrow et al. | 244/3.28 |
| 5,584,448 | A | * | 12/1996 | Epstein et al. | 244/3.28 |
| 5,892,217 | A | * | 4/1999 | Pollin | 102/439 |
| 6,186,443 | B1 | * | 2/2001 | Shaffer | 244/3.29 |
| 6,352,218 | B1 | * | 3/2002 | Holmqvist et al. | 102/490 |

FOREIGN PATENT DOCUMENTS

| | | |
|---|---|---|
| DE | 34 08 585 | 9/1985 |
| GB | 1174120 | 12/1969 |
| GB | 1 422 987 | 1/1976 |
| GB | 2 246 330 | 1/1992 |

* cited by examiner

*Primary Examiner*—Charles T. Jordan
*Assistant Examiner*—Stephen A Holzen
(74) *Attorney, Agent, or Firm*—Venable; Gabor J. Kelemen

(57) ABSTRACT

A fin-stabilized projectile includes a projectile body having a rear portion defining a rearwardly open cavity and a stabilizing assembly which has an axially slidable fin support in the cavity. The fin support has a retracted position in which the fin support is withdrawn into the cavity and an outwardly shifted position in which the fin support projects from the projectile body. A plurality of fins are pivotally held in the fin support. Each fin has a folded state in which it is withdrawn in the fin support when the latter is in the retracted position and a deployed state in which it is unfolded and extends substantially externally of the fin support when the latter is in its outwardly shifted position. When the projectile has left the weapon barrel, the fin support is axially shifted and the fins move into the deployed state.

11 Claims, 4 Drawing Sheets

FIN-STABILIZED PROJECTILE

CROSS REFERENCE TO RELATED APPLICATION

This application claims the priority of German Application No. 100 15 514.6 filed Mar. 30, 2000, which is incorporated herein by reference.

BACKGROUND OF THE INVENTION

This invention relates to a fin-stabilized projectile having fins mounted at the rear portion of the projectile and pivotal about respective rotary axes oriented transversely to the longitudinal projectile axis.

In a known projectile of the above type, described, for example in German patent document 34 08 585, the fins movably supported in the rear portion of the projectile can unfold exclusively under the effect of centrifugal forces generated during spin of the projectile, for moving the fins into their effective, deployed position to stabilize the projectile. Deploying fins in this manner, however, is not possible in projectiles which do not spin during flight, such as artillery projectiles where torque transmission from the barrel rifling to the projectile is prevented by a guide band which rotates relative to the projectile.

Also disadvantageously, in the known projectile the fins project in their folded state beyond the rearward end of the projectile. Therefore, such a projectile cannot be used in artillery systems in which predetermined barrel lengths or volumes and thus predetermined interfaces have to be observed for the projectile, on the one hand and, for example, for the propellant, on the other hand. By virtue of the fact that in such a prior art projectile the air pressure point cannot be altered with respect to the center of gravity of the projectile, no sufficient improvement of the flight stability is possible. It is a further disadvantage that the known fin arrangement provides no space for a payload.

SUMMARY OF THE INVENTION

It is an object of the invention to provide an improved deployable guide assembly for stabilizing a substantially non-spinning artillery projectile in such a manner that in the folded state of the guide assembly the projectile volume is not exceeded with respect to predetermined interfaces, but nevertheless, an improvement of the aerodynamic properties is achieved in the deployed state of the guide assembly.

This object and others to become apparent as the specification progresses, are accomplished by the invention, according to which, briefly stated, the fin-stabilized projectile includes a projectile body having a rear portion defining a rearwardly open cavity and a stabilizing assembly which has a fin support accommodated in the cavity and is axially slidable relative thereto. The fin support has a withdrawn position in which the fin support is substantially retracted into the cavity and an axially outwardly shifted position in which the fin support projects rearward and outwardly from the projectile body. A plurality of fins are held in the fin support for pivotal motion about an axis transverse to the longitudinal projectile axis. Each fin has a folded state in which it is retracted in the fin support when the latter is in the withdrawn position and a deployed state in which it is unfolded and extends substantially externally of the fin support when the latter is in its outwardly shifted position. Arrangements are provided which axially displace the fin support when the projectile has left the weapon barrel after firing and which move the fins into the deployed state when the fin support assumes its outwardly shifted position.

The invention is based on the basic principle to arrange the fins in a fin support which is located at the rear portion of the projectile and which is axially rearwardly slidable, whereby a significant improvement of the flight stability is achieved by a rearward relocation of the air pressure point at the guide assembly with respect to the approximately constant center of gravity of the projectile.

Further, the invention provides that after the projectile has left the weapon barrel, the fins may, in the axially displaced position of the fin support, unfold automatically into the deployed end position without needing centrifugal forces therefor.

Advantageously, the axial displacement of the fin support is effected by directing the propellant gases through apertures, provided in the fin support, into a chamber which is situated in the projectile in front of the fin support. Thus, in the chamber approximately the same pressure prevails as behind the projectile during its travel within the weapon barrel. A higher pressure in the chamber will develop only as the projectile leaves the weapon barrel and thus a pressure drop externally of the weapon barrel occurs. As a result, the higher pressure in the chamber shifts the fin support axially rearward, partially out of the projectile body. Thereafter a respective compression spring positioned at each two-part fin effects an automatic deployment of the fins from a space-saving folded, initial position within the projectile into an outward telescoping, deployed, operating position in which the fin length is doubled compared to its folded state. Such a deployment step is further advantageously achieved in a first phase by obliquely configured fin edges gliding on corresponding oblique slide faces provided on the fin support and in a second phase by the forces derived from the air flow and acting on the fins.

In addition to the above-described significant improvement of the flight stability, the invention further makes possible, due to the space-saving arrangement of the fins, the accommodation of a substantial payload, such as a base-bleed assembly.

DESCRIPTION OF THE PREFERRED EMBODIMENT

Figure 1:
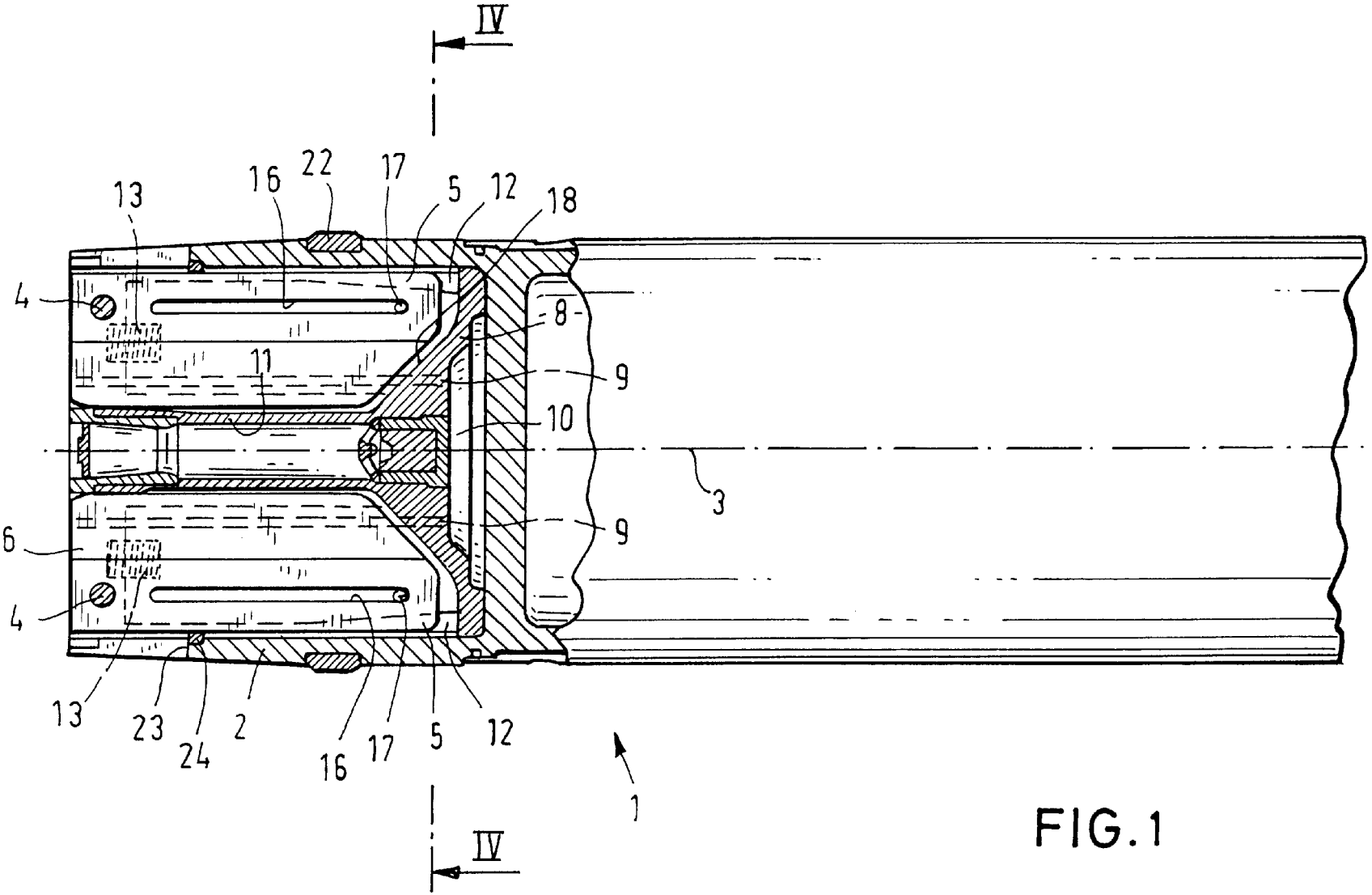
FIG. 1 is an axial sectional view of a rear portion of a projectile, illustrating a preferred embodiment of the invention wherein the fin support is shown in a retracted position and the fins in a folded, initial state.

FIG. 1 illustrates an artillery projectile body 1 having a guide band 22 mounted thereon and rotatable relative thereto. Thus, substantially no spin is imparted on the projectile body 1 as it travels through the weapon barrel and therefore the projectile has to be stabilized by fins. For this purpose the rear portion 2 of the projectile body 1 has an axially shiftable fin support 6 on which at least two deployable fins 5 are pivotally mounted. The fins 5 are outwardly pivotally supported on pins 4 held at the rear end portion of the fin support 6 for pivotal motion about an axis which is transverse to the longitudinal projectile axis 3. Also referring to FIG. 2, the fin support 6 is configured such that the fins 5 may assume their outwardly pivoted, deployed, operational state 7 only in the outwardly shifted position of the fin support 6, after the projectile has left the weapon barrel.

Figure 5:
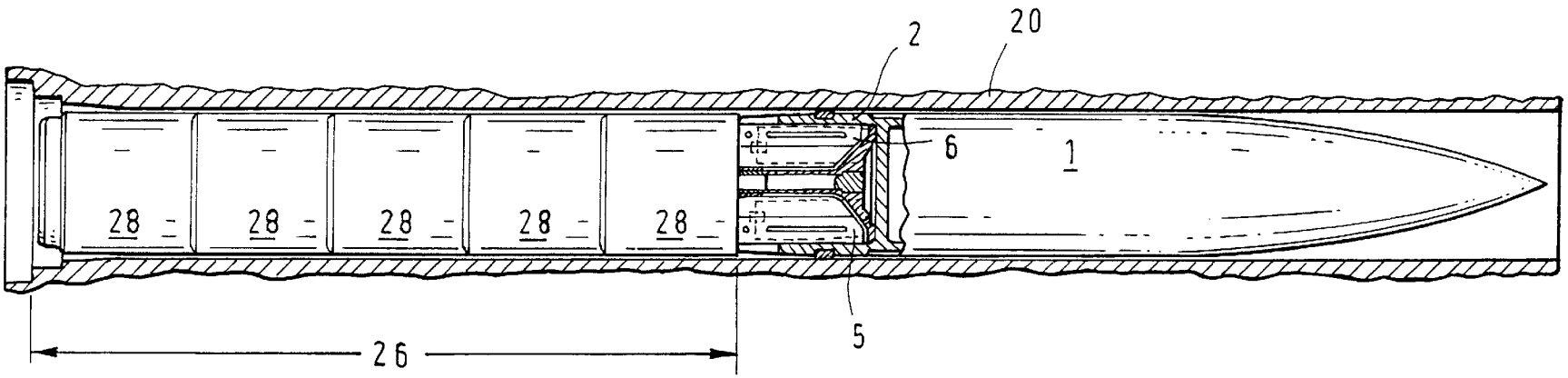
FIG. 5 is a fragmentary axial sectional view of a weapon barrel and a projectile positioned therein and including the stabilizing fin guide assembly according to the invention and showing interfaces, for example, between projectile and propellant chamber.

Reverting to FIG. 1 and also referring to FIG. 5, the fins 5 are shown in the inwardly folded, initial state, for example, prior to the ignition of a propellant charge 28. At its frontal end wall 8 the fin support 6 has apertures 9 for connecting a chamber 10 situated between the fin support 6 and the projectile body 1 with the propellant (charge) chamber 26 of the weapon barrel 20. After the propellant 28 is ignited, the high-pressure propellant gases enter the chamber 10 sealed by a non-illustrated seal and, after the projectile has left the weapon barrel 20, cause, by virtue of the pressure difference between the pressure prevailing in the chamber 10 and the atmosphere, an axial shift of the fin support 6 outwardly from the rear portion 2 of the projectile body 1.

For allowing such a rearward axial shift of the fin support 6, the latter is disposed in a rear cavity 21 of the projectile body 1. The cavity 21 is provided at its rearward end 23 with an abutment 24 which projects into an axially extending groove 29 of the fin support 6. The abutment 24 serves for axially guiding the fin support 6 for preventing it from rotating and for limiting the extent of its displacement. The abutment may also be so configured that it functions as a seal of the fin support 6 against the propellant chamber 26.

In the initial position illustrated in FIG. 1, the fin support 6 is coupled to non-illustrated safety means in the rear portion 2 of the projectile body 1. The safety means securely hold the fin support 6 in its initial (retracted) position until the gas pressure prevailing in the chamber 10 overcomes the safety means (for example, by shearing) and initiates the outward shift of the fin support 6. For accommodating the fins 5 in their folded state, the-fin support 6 has slot-like recesses 12 which extend perpendicularly to the longitudinal projectile axis 3. The recesses 12 conform to the contour of the respective fins 5 and are rearwardly and outwardly open. In front they are bounded by the end face 8 and from the inside by the wall 11 of a base-bleed assembly 25 shown in more detail in FIGS. 3 and 4.

Figure 2:
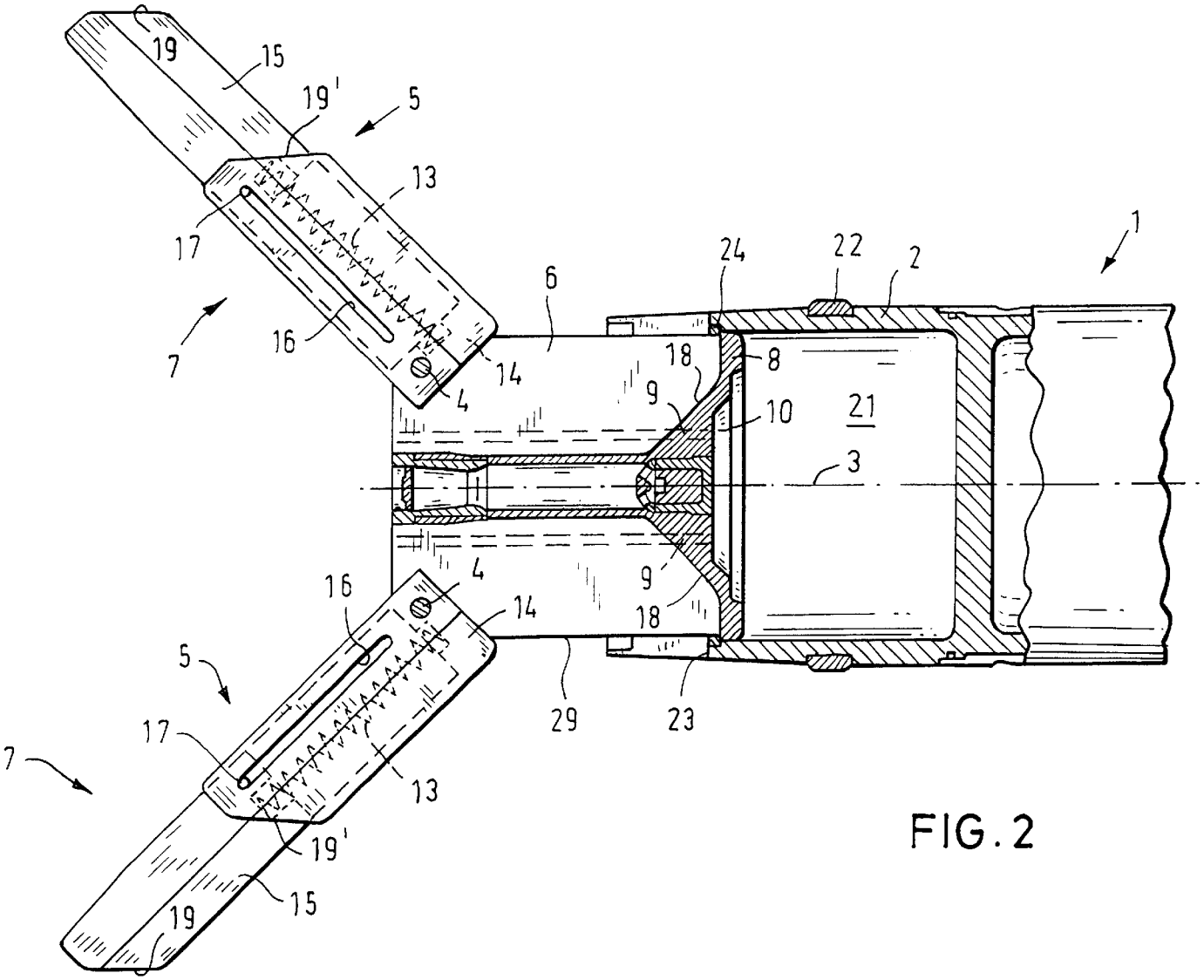
FIG. 2 is a view similar to FIG. 1, illustrating the fin support in an axially outwardly shifted position and the fins in an operating, deployed state.

As best seen in FIG. 2, each fin 5 is composed of a first fin portion 14 pivotally mounted on a respective pin 4 and a second fin portion 15 guided in a guide 16 of the first fin portion 14 and shiftable relative to the first fin portion 14 parallel to the fin axis. The extent of axial shift of the second fin portion 15 is limited by an abutment 17 affixed to the second fin portion 15 and extending into the guide 16.

A compression spring 13 extends into recesses of the respective rearward end of the first and second fin portions 14 and 15 and is shown in its pre-tensioned state in FIG. 1. To permit the fins 5 to pivot outwardly after the fin support 6 has shifted into its outward position, the respective recess 12 of the fin support 6 has a slide face 18 arranged in the region of the frontal end face 8 and extends obliquely outward and forward. Further, the respective first and second fin portions 14 and 15 have oblique fin edges 19, 19' which, in their folded state of the fin portions 14, 15, extend parallel to the slide face 18 of the fin support 6. By virtue of this arrangement, in the outwardly shifted position of the fin support 6, the respective fin edges 19 glide on the oblique slide faces 18 as urged by the spring 13 and project beyond the external contour of the projectile 1. Thus, the fin portions 14 and 15 may subsequently assume their outwardly pivoted and telescopically extended terminal position under the effect of forces derived from air flow. In such an end position (FIG. 2) the fins 5 have approximately an effective length for stabilizing the projectile which is twice their length in their folded, inwardly telescoped state. As further seen in FIG. 2, in its outward shifted position the fin support 6 engages the abutment 24 with its frontal end wall 8 at the rearward end 23 of the projectile chamber 21. The abutment 24 is at an axial distance from the outer guide band 22 of the projectile 1 so that the deployment of the fins 5 does not interfere with the guide band 22.

Figure 4:
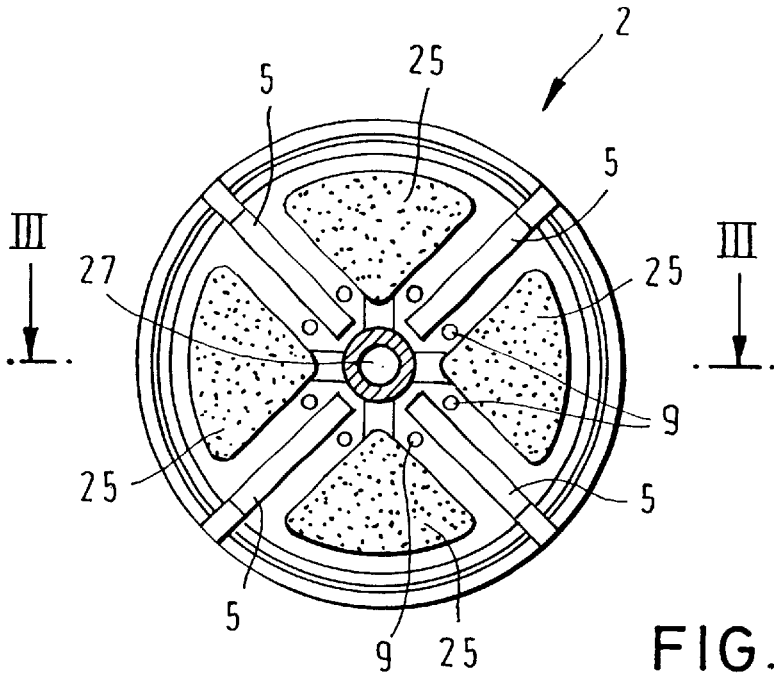
FIG. 4 is a sectional view taken along line IV—IV of FIG. 1.
Figure 3:
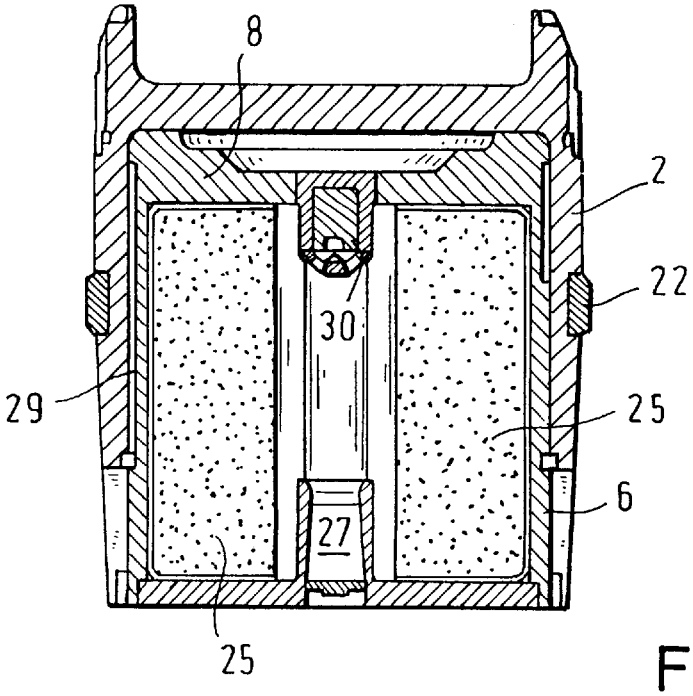
FIG. 3 is an axial sectional view taken along line III—III of FIG. 4 and showing a payload accommodated in the fin support.

FIGS. 3 and 4 show a space-saving arrangement of preferably four circumferentially uniformly distributed fins 5 within the fin support 6. In the free space between any two adjoining fins 5 a large-volume payload, preferably a base-bleed assembly 25 may be arranged. The apertures 9 in the frontal face 8 of the fin support 6 are, in such an arrangement, situated externally of the wall 11 of the ignition channel 27 and the ignition assembly 30 of the base-bleed assembly 25.

It will be understood that the above description of the present invention is susceptible to various modifications, changes and adaptations, and the same are intended to be comprehended within the meaning and range of equivalents of the appended claims.

What is claimed is:

1. A fin-stabilized projectile comprising (a) a projectile body having a longitudinal projectile axis;

(b) a rear portion including a rearwardly open cavity; and (c) a stabilizing assembly including (1) a fin support accommodated in said cavity and being axially slidable relative thereto; said fin support having a retracted position in which said fin support is substantially withdrawn into said cavity and an axially outwardly shifted position in which said fin support projects rearward and outwardly from said projectile body;

(2) a plurality of fins held in said fin support for pivotal motion about an axis transverse to the longitudinal projectile axis; each fin having a folded state in which it is withdrawn in said fin support when said fin support is in said retracted position and a deployed state in which it is in an unfolded state and extends substantially externally of said fin support when said fin support is in said outwardly shifted position;

(3) first means for axially displacing said fin support when the projectile has left a weapon barrel after firing; said first means including (i) a frontal end wall forming part of said fin support;

(ii) a chamber forming part of said cavity and defined between a rearward end of said projectile body and said frontal end wall of said fin support when said fin support is in said retracted position; and (iii) a through aperture provided in said frontal end wall of said fin support for maintaining communication between said chamber and an environment outside said chamber, whereby gas pressure in said chamber shifts said fin support into said outwardly shifted position in response to a difference in pressures prevailing in said chamber and in the environment outside said chamber; and (4) second means for moving said fins into said deployed state when said fin support assumes said outwardly shifted position.

2. The projectile as defined in claim 1, further comprising respective pivot pins secured at a rearward portion of said fin support for pivotally holding each said fin.

3. The projectile as defined in claim 2, wherein said fins are four in number.

4. The projectile as defined in claim 1, wherein said fin support comprises recesses oriented perpendicularly to said longitudinal projectile axis for accommodating said fins in said folded state thereof.

5. The projectile as defined in claim 1, wherein said cavity has a rear portion, further comprising (d) a guide band mounted on and surrounding said projectile body; and (e) an abutment fixedly disposed in said rear portion of said cavity of said projectile body for limiting an extent of rearward axial shift of said fin support; said abutment being axially rearwardly spaced from said guide band.

6. The projectile as defined in claim 1, further comprising a payload accommodated within said fin support between said fins; said payload being carried by said fin support during axial shift thereof.

7. The projectile as defined in claim 6, wherein said payload is a propellant assembly.

8. The projectile as defined in claim 6, wherein said payload is a base-bleed assembly.

9. A fin-stabilized projectile comprising (a) a projectile body having a longitudinal projectile axis;

(b) a rear portion including a rearwardly open cavity; and (c) a stabilizing assembly including (1) a fin support accommodated in said cavity and being axially slidable relative thereto; said fin support having a retracted position in which said fin support is substantially withdrawn into said cavity and an axially outwardly shifted position in which said fin support projects rearward and outwardly from said projectile body;

(2) a plurality of fins held in said fin support for pivotal motion about an axis transverse to the longitudinal projectile axis; each fin having a folded state in which it is withdrawn in said fin support when said fin support is in said retracted position and a deployed state in which it is in an unfolded state and extends substantially externally of said fin support when said fin support is in said outwardly shifted position; each said fin having (i) a length dimension;

(ii) a first fin portion pivotally secured to said fin support;

(iii) a second fin portion mounted on said first fin portion and slidable parallel to said length dimension on said first fin portion relative thereto; and (iv) a spring urging said second fin portion to slide away from said fin support;

(3) first means for axially displacing said fin support when the projectile has left a weapon barrel after firing; and (4) second means for moving said fins into said deployed state when said fin support assumes said outwardly shifted position.

10. The projectile as defined in claim 9, wherein said second fin portion has a guide for guiding said first fin portion in the sliding motion thereof; and an abutment in said guide for limiting an extent of sliding motion of said first fin portion.

11. The projectile as defined in claim 9, wherein said fin support has a frontal end wall provided with a rearward extending slide face oriented obliquely to said longitudinal axis; further wherein the first and second fin portions of each said fin have fin edges oriented obliquely to said length dimension; said fin edges facing and extending parallel to said slide face of said frontal end wall, whereby said fin edges glide on said slide face of said frontal end wall during deployment of said fins.

* * * * *